United States Patent [19]

Takegawa et al.

[11] Patent Number: 4,735,237

[45] Date of Patent: Apr. 5, 1988

[54] MULTI-NOZZLE WEFT INSERTION DEVICE FOR A FLUIDIC JET SHUTTLELESS-LOOM

[75] Inventors: Yujiro Takegawa, Ishikawa; Fumio Matsuda, Kanazawa, both of Japan

[73] Assignee: Tsudakoma Kogyo Kabushiki Kaisha, Kanazawa, Japan

[21] Appl. No.: 21,243

[22] Filed: Mar. 3, 1987

[30] Foreign Application Priority Data

Mar. 8, 1986 [JP] Japan ..... 61-51269

[51] Int. Cl.[4] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 3,180,368 | 4/1965 | Kobayashi | 139/435 |
| 4,353,397 | 10/1982 | Tera et al. | 139/435 |
| 4,367,772 | 1/1983 | Wall | 139/435 |

FOREIGN PATENT DOCUMENTS

| | | | |
|---|---|---|---|
| 184435 | 6/1986 | European Pat. Off. | 139/435 |
| 167053 | 7/1986 | Japan | 139/435 |

*Primary Examiner*—Henry S. Jaudon

[57] ABSTRACT

A multi-nozzle weft insertion device is described having a group of independent nozzles, each nozzle corresponding to the weft to be inserted and having a jet orifice, wherein the jet orifices in a bundle point to a weft-path. The device includes a guide tube which has a diameter substantially equal to or somewhat larger than the diameter of the bundle of the jet orifices and is placed opposite the jet orifices; and partitions which extend at least within the inner circumferential area of the guide tube and which are disposed opposite openings formed between the jet orifices, in order to separate the wefts and guide them into the weft-path without contact.

11 Claims, 2 Drawing Sheets

MULTI-NOZZLE WEFT INSERTION DEVICE FOR A FLUIDIC JET SHUTTLELESS-LOOM

BACKGROUND OF THE INVENTION

The present invention relates to a weft insertion device and, more particularly to a high-performance multi-nozzle weft insertion device substantially preventing wefts from getting entangled with each other or caught in openings between bundled nozzle jet orifices.

A well-known multi-nozzle weft insertion device for a fluidic jet shuttleless-loom includes a group of independent weft-jetting nozzles, each nozzle corresponding to the weft to be inserted and having a jet orifice. The jet orifices in a bundle point to a weft-path.

Such a conventional device, however, frequently causes an error or failure in weft insertion due to the facts that:

(a) the wefts get entangled with each other during the weaving operation;

(b) the weft springs back and gets caught in the opening between adjacent nozzle jet orifices when the inserted weft is cut; and (c) the wefts get caught in the openings between the jet orifices when they are pulled out from the jet orifices to have their ends aligned with each other, or when the loom is started with the pulled-out wefts being hooked on temples.

Thus, a need exists to improve weaving efficiency and quality control when a multi-nozzle weft insertion device is used.

SUMMARY OF THE INVENTION

Accordingly, it is an object of the present invention to overcome the above-mentioned problems associated with a multi-nozzle weft insertion device for a fluidic jet shuttleless-loom and to provide a high-performance multi-nozzle weft insertion device that can prevent the wefts from getting entangled and/or otherwise accompanying each other by unforcibly restraining the weft passage so as to hold the wefts in a proper posture.

It is another object of the present invention to provide a highly efficient multi-nozzle weft insertion device that can continuously operate without the wefts getting caught in the openings between the jet orifices, even if the wefts spring back when they are inserted and thereafter cut.

It is still another object of the present invention to provide an economical multi-nozzle weft insertion device that is simple in structure, inexpensive to manufacture, operates reliably and exhibits little loss of energy due to the jet energy diffustion.

To achieve the foregoing and other objects of the present invention and in accordance with the purposes of the invention, there is provided an improved multi-nozzle weft insertion device having a group of independent nozzles, each nozzle corresponding to the weft to be inserted and having a jet orifice, wherein the jet orifices bundled together point to a weft-path. The multi-nozzle weft insertion device also includes a guide tube which has a diameter substantially equal to or somewhat larger than the diameter of the bundle of jet orifices and which is provided near the front of the jet orifices in opposite relation thereto. The guide tube restricts the violent movement of the wefts and the fluidic diffusion near the nozzle jet orifices. Partitions are also provided extending at least into the inner circumferential area of the guide tube. The partitions are disposed opposite to the openings between the jet orifices, in order to separate and guide the wefts into the weft-path without contact. With the combined use of the guide tube and partitions, the present invention can reliably and precisely perform insertion of many kinds of wefts.

Other objects and advantages of the present invention will be more apparent from the following description taken in connection with the accompanying drawings.

DETAILED DESCRIPTION OF THE PREFERRED EMBODIMENTS

Figure 1:
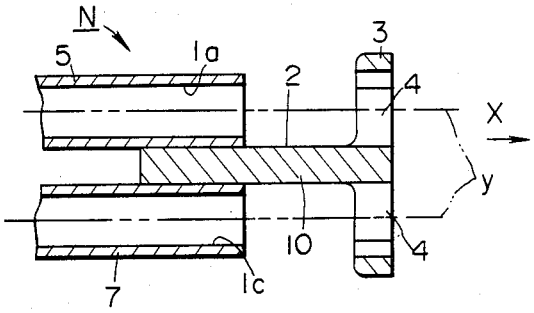
FIG. 1 is a sectional view of a first embodiment of a nozzle according to the present invention.
Figure 2:
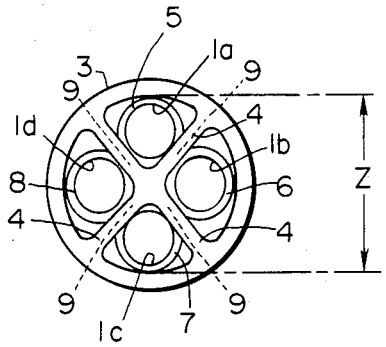
FIG. 2 is a front view of the nozzle shown in FIG. 1.

Referring to FIGS. 1 to 8, there is shown a nozzle N made up of four pipes 5, 6, 7 and 8. Each pipe 5, 6, 7 and 8 includes a jet orifice 1*a*, 1*b*, 1*c* and 1*d*, respectively, for jetting out four kinds of wefts Y shown by the dotted lines in FIG. 1. These jet orifices 1*a*, 1*b*, 1*c* and 1*d* are each substantially identical in structure and are bundled together to point to a weft path indicated by arrow X. In the front of the nozzle N, there are provided a support member 2 that is fixed at the center of the nozzle N; a guide tube 3 attached to the support member 2 and disposed opposite to the nozzle N; and a plurality of partitions 4, each disposed opposite the space 9 formed between the adjacent pipes 5, 6, 7 and 8.

Figure 5:
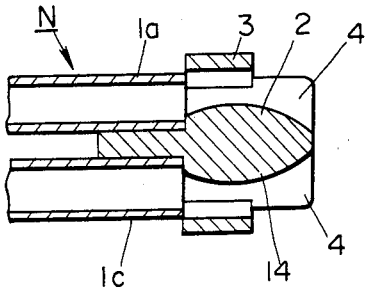
FIG. 5 is a sectional view of a third embodiment of a nozzle according to the present invention.
Figure 6:
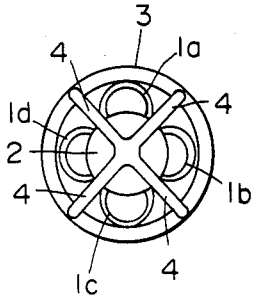
FIG. 6 is a front view of the nozzle shown in FIG. 5.

The fixed support member 2 holds the guide tube 3 and the partitions 4 at a predetermined position. The support member 2 for the first embodiment has a straight body section 10 as shown in FIG. 1, while the support member 2 for the second, third and fourth embodiments has a streamlined body section 12, 14 and 16 to create a flow-rectifying effect as shown in FIGS. 3, 5 and 7, respectively.

The reasons for using the streamlined support member 2 in the second through fourth embodiments is because the fluid jetted out from the jet orifices 1*a*, 1*b*, 1*c* and 1*d* forms a streamlined flow along the exterior of the support member 2 and guides and transfers wefts in the correct direction of the weft-path X, thereby assuring more precise weft insertion.

The guide tube 3 is manufactured to have its internal diameter Z equal to or somewhat larger than the diameter of the bundle of jet orifices 1*a*, 1*b*, 1*c* and 1*d*.

Figure 3:
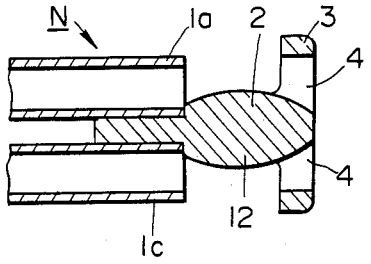
FIG. 3 is a sectional view of a second embodiment of a nozzle according to the present invention.
Figure 4:
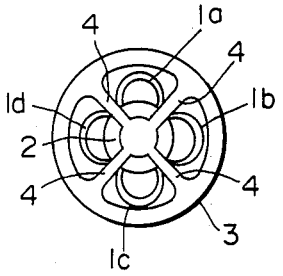
FIG. 4 is a front view of the nozzle shown in FIG. 3.
Figure 7:
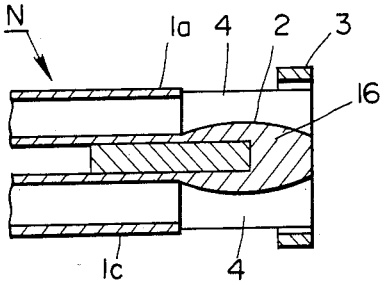
FIG. 7 is a sectional view of a fourth embodidment of a nozzle according to the present invention.
Figure 8:
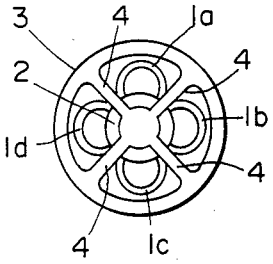
FIG. 8 is a front view of the nozzle shown in FIG. 7.

In the first, second and fourth embodiments, the guide tube 3 is disposed a little away from and opposite to the jet orifices 1*a*, 1*b*, 1*c* and 1*d* (See FIGS. 1, 3 and 7). On the other hand, the guide tube 3 in the third embodiments surrounds the jet orifices 1*a*, 1*b*, 1*c* and 1*d* as if adhered thereto (See FIG. 5).

As stated above, the partitions 4 are disposed opposite to the space 9 formed between the jet orifices 1*a*, 1*b*, 1*c* and 1*d*. In the first and second embodiments, the partitions 4 are fixed at the end of the support member 2 and divide only the inner circumferential area of the guide tube 3. (See FIGS. 1 and 3). In the third embodiment, the partitions 4 divide the space along the length of the support member 2 and protrude from the outer circumferential area of the guide tube 3 (See FIG. 5). In the fourth embodiment, the partitions divide the space along the length of the support member 2, namely all the area extending from the jet orifices 1*a*, 1*b*, 1*c* and 1*d* to the guide tube 3 (See FIG. 7).

Having described the embodiments of the present invention, it is to be understood that the invention is not limited thereto but that various modifications may be made in the invention without departing from the scope thereof. For example, the number of the weft-inserting nozzles may be decreased or increased, the guide tube 3 may be telescopically adjustable, or the guide tube 3 may be fitted onto the weft-inserting nozzles. It is the inventor's intention to put to use the above described modifications, which are obviously included in the scope of the present invention.

As described above, the present invention comprises a guide tube disposed opposite to the front of the bundle of jet orifices. The inner circumferential surface of the guide tube restrains the wefts and immediately puts the wefts into a proper posture and position, even if the wefts spring back and move violently when the loom is started or when the wefts are inserted and cut. Finally, partitions extend for a predetermined area and are disposed in the front of the nozzle jet orifices and opposite to spaces formed therebetween, said partitions substantially preventing the wefts from getting entangled or otherwise accompanying each other at the time of inserting the wefts.

Further, by adopting a streamlined, flow-rectifying body section 12, 14, 16 as part of the support member 2 for holding the guide tube 3 and the partitions 4 at a predetermined position, the fluid jetted out from the nozzle jet orifices 1*a*, 1*b*, 1*c* and 1*d* can form a streamlined flow along the exterior of the support member 2 and accordingly guide and transfer the wefts Y in the correct direction toward the weft-path, thereby ensuring higher precision in weft insertion.

As described above, the present invention effectively overcomes the difficult problems of the conventional multi-nozzle weft insertion device, remarkably improves weaving efficiency and extremely diminishes weft-inserting error which normally results in a defective product. Furthermore, the present invention provides a device which is mechanically simple, inexpensive to manufacture, operates reliably and has little loss of energy due to the jet energy diffusion, thereby providing practical and economical merits such as a decrease in operating costs.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention and the appended claims.

What is claimed is:

1. A multi-nozzle weft insertion device for a fluidic jet shuttleless-loom, including a group of independent nozzles, each nozzle corresponding to the weft to be inserted and having a jet orifice, the jet orifices each having an end and grouped in a bundle pointing to a weft-path, the device comprising:

(a) a guide tube having a diameter at least as large as the diameter of the bundle of the jet orifices, said guide tube being provided in the proximity of the front of the bundled jet orifices and opposite thereto; and (b) partitions disposed at least within the inner circumferential area of said guide tube, said partitions separating the wefts jetted out from the jet orifices.

2. The multi-nozzle weft insertion device as claimed in claim 1, further comprising:

(c) a support member disposed in the front of the jet orifices, for positioning the guide tube opposite and in the proximity of the jet orifices.

3. The multi-nozzle weft insertion device as claimed in claim 1, wherein said guide tube surrounds the bundled jet orifices near the ends thereof.

4. The multi-nozzle weft insertion device as claimed in claim 1 or 2, wherein said partitions extend from the ends of the jet orifices to the guide tube and separate the adjacent jet orifices from each other.

5. The multi-nozzle weft insertion device as claimed in claim 1 or 3, wherein said partitions protrude forward from the guide tube away from the jet orifices.

6. The multi-nozzle weft insertion device as claimed in claim 1, wherein a streamlined, flow-rectifying body is adopted for the support member, and the fluid jetted out from the jet orifices contacts said streamlined support member and is rectified into a streamlined flow and guided toward the weft-path.

7. The multi-nozzle weft insertion device as claimed in claim 2, wherein a streamlined, flow-rectifying body is adopted for the support member, and the fluid jetted out from the jet orifices contacts said streamlined support member and is rectified into a streamlined flow and guided toward the weft-path.

8. The multi-nozzle weft insertion device as claimed in claim 3, wherein a streamlined, flow-rectifying body is adopted for the support member, and the fluid jetted out from the jet orifices contacts said streamlined support member and is rectified into a streamlined flow and guided toward the weft-path.

9. The multi-nozzle weft insertion device as claimed in claim 4, wherein a streamlined, flow-rectifying body is adopted for the support member, and the fluid jetted out from the jet orifices contacts said streamlined support member and is rectified into a streamlined flow and guided towards the weft-path.

10. The multi-nozzle weft insertion device as claimed in claim 5, wherein a streamlined, flow-rectifying body is adopted for the support member, and the fluid jetted out from the jet orifices contacts said streamlined support member and is rectified into a streamlined flow and guided toward the weft-path.

11. A multi-nozzle weft insertion device for a fluidic jet shuttleless-loom, including a group of independent nozzles, each nozzle corresponding to the weft to be inserted and having a jet orifice, the jet orifices each having an end and grouped in a bundle pointing to a weft-path, the device comprising:

(a) a guide tube having a diameter at least as large as the diameter of the bundle of the jet orifices, said guide tube being provided in the proximity of the ends of the bundled jet orifices and opposite thereto;

(b) partitions disposed at least within the inner circumferential area of said guide tube, said partitions separating the wefts jetted out from the jet orifices;

wherein said partitions extend from the ends of the jet orifices, protrude forward from the guide tube and separate the adjacent jet orifices from each other; and (c) support member disposed in the front of the jet orifices, for positioning the guide tube opposite to and in the proximity of the jet orifices.

* * * * *